US006691992B1

(12) United States Patent
Mungo

(10) Patent No.: US 6,691,992 B1
(45) Date of Patent: Feb. 17, 2004

(54) TOOL FOR BUILDING AND REPAIRING WALLS

(76) Inventor: Timothy Mungo, 947 Center Rd., Staatsburg, NY (US) 12580

( * ) Notice: Subject to any disclaimer, the term of this patent is extended or adjusted under 35 U.S.C. 154(b) by 0 days.

(21) Appl. No.: 10/303,210

(22) Filed: Nov. 25, 2002

(51) Int. Cl.[7] ..... B25B 1/20

(52) U.S. Cl. ..... 269/43; 269/95; 269/904; 269/102; 269/6

(58) Field of Search ..... 269/43, 6, 3, 102, 269/289 MR, 95, 904, 900; 52/489.1, 127.2; 248/250

(56) References Cited

U.S. PATENT DOCUMENTS 4,164,346 A * 8/1979 Sickler ..... 269/289 MR
5,564,236 A * 10/1996 McKinney et al. ..... 52/127.2
5,611,189 A * 3/1997 Fleck ..... 52/702
5,884,447 A * 3/1999 Earp ..... 52/489.1
6,367,160 B1 * 4/2002 Rempe ..... 33/647

* cited by examiner

*Primary Examiner*—Lee Wilson
(74) *Attorney, Agent, or Firm*—Fulbright & Jaworski L.L.P.

(57) ABSTRACT

A tool for positioning and installing paneling sections, such as drywall sections, on underlying walls. The tool is initially secured to a wall, and comprises a vertical surface parallel to the wall and a downwardly angled surface. These surfaces, together with the wall, form a gap, which accommodates and temporarily holds a paneling section in place and therefore allows for easy installation and/or repositioning of the paneling. The downwardly angled surface forces the paneling section against the wall. The tool also may include a mounting surface with screw slots, these screw slots being capable of engaging and disengaging the screw to permit easy removal of the tool following use. A second angled surface may be positioned so as to guide the paneling into the gap.

5 Claims, 3 Drawing Sheets

TOOL FOR BUILDING AND REPAIRING WALLS

FIELD OF THE INVENTION

The present invention relates to a tool for installing walling materials, for example dry wall. The inventive tool permits the installer to easily position and evaluate the placement of large, flat walling materials with respect to a stud wall or other underlying wall structure without the need to permanently secure the material to the underlying wall.

BACKGROUND

Efficiently installing walling materials such as dry wall, wood paneling (hereafter, collectively "drywall") is critical to virtually every commercial and residential construction project. Yet, installers typically encounter a variety of difficulties due to the nature of drywall. Drywall is very heavy, and its large flat dimensions make it difficult to transport and handle. Drywall is also relatively fragile and has been known to crack, warp or splinter when dropped or mishandled.

Often it is desirable to position a dry wall section in a temporary manner so that the installer can step away from the dry wall section and evaluate whether placement is proper, or perhaps should be adjusted. If an adjustment is warranted, the temporary position of the drywall desirably could be altered without the need to "uninstall" the section. At present, however, there is no simple, safe and effective method by which an installer, particularly an installer working alone, can position a drywall section on a stud wall or other underlying wall (hereafter, "underlying wall") without permanently fixing the drywall section in place with nails, screws, adhesives or other means. Use of these means is less than efficient in that they render subsequent repositioning more difficult and cause delays in the construction project. Of course two (or more) installers may work together with one installer positioning the drywall while the other evaluates placement. Obviously this technique is more labor intensive and as a result more costly.

Another difficulty encountered by workers installing drywall sections is in vertically lifting drywall sections already positioned against an underlying wall. Typically this problem occurs when a drywall section must be lifted a short distance from the floor, but where gripping access to the sides of the section is impossible or difficult, for instance because of adjoining drywall sections already in place, the existence of other walls or fixtures, or other physical blockages. It is also very difficult to grip the face of the drywall section.

SUMMARY OF THE INVENTION

The inventive tool is used for positioning and installing paneling sections, for instance drywall, wood paneling, composite paneling, and other generally flat materials, on underlying walls. (This application will refer to these materials collectively as "drywall".) It solves the problems described above, and includes a number of additional features designed to assists workers in safely and efficiently installing drywall.

The tool is first affixed to the underlying wall by screws, nails, or other securing means. One or more tools may be used by the drywall installer depending upon the size of the drywall section to be positioned.

The tool includes several handling and holding surfaces. As described in detail below, these surfaces serve as side and bottom walls which, along with the surface of the underlying wall, form a gap into which the drywall is to be placed. The bottom of this gap is angled such that when drywall is placed in the gap it is forced, by action of its own weight, tightly against the underlying wall. An upper portion of the tool is also designed with an angled surface such that drywall may be guided into the gap with a minimum of difficulty.

In applications where drywall sections have already been permanently affixed to an underlying wall and the installer seeks to position additional sections, the tool may be positioned such that the angled gap bottom guides the additional section into place but does not serve to support the additional section. Here, the previously installed section will act as a support.

The invention also permits the efficient vertical lifting of drywall sections. The pointed tip of the tool is positioned below the drywall section to be lifted. Angled sections of the tool form a pivot point or fulcrum such that downward pressure on the portion of the tool remote from the drywall, for instance pressure from the hand or foot of the installer, causes the pointed tip portion, and the drywall section above it, to be raised.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

The below detailed description is given by way of example and is not intended to limit the present invention solely to the embodiments described therein. The description is best be understood in conjunction with the accompanying drawings.

DETAILED DESCRIPTION

Figure 1:
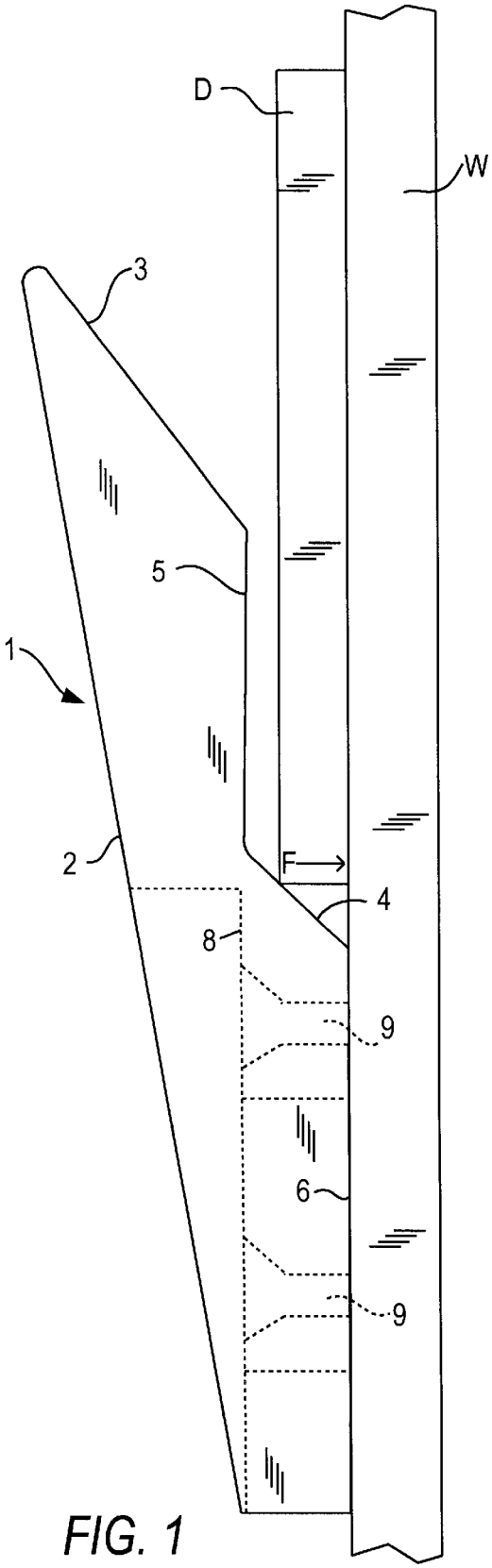
FIG. 1 is a side view of the inventive installation tool with dashed lines showing the cutaway section and screw slots. The figure also shows a drywall work piece being positioned by the tool.
Figure 2:
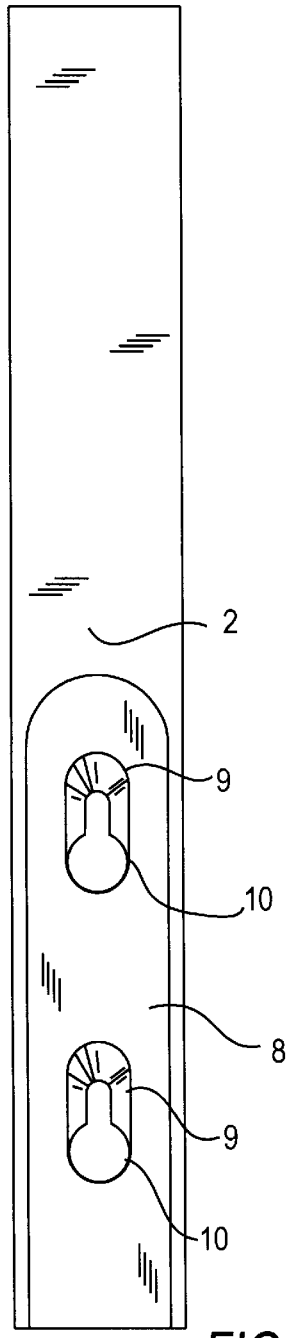
FIG. 2 is a view of the tool showing the side of the tool facing away from the underlying wall with keyhole screw slots shown.

In FIG. 1 it is seen that the inventive tool (1) includes an elongated outer surface (2), a first angled surface (3), a second angled surface (4), and inner surface (5) and a mounting surface (6). Referring to FIG. 1 and FIG. 2, the tool also includes a cutaway surface (8) and screw slots (9).

In use, the tool is mounted to an underlying wall (W) by means of screws (S) or some other securing means inserted through the cutaway surface (8) and the screw slots (9) such that the mounting surface (6) is substantially flush with the surface of the underlying wall. With the tool secured to the wall (W), a drywall section (D) is positioned within the gap formed by the surface of the wall, the inner surface (5) and the second angled surface (4). The first angled surface is designed to "catch" the drywall as it is lowered and to direct the edge of the drywall section into the gap. The second angled surface serves to support the drywall section and also to force it into close contact with the wall as indicated by arrow (F).

It is to be noted that the width of the gap between the wall surface and the inner surface may be engineered so as to accommodate a number of different potential drywall thicknesses, with the second angled surface being capable of forcing panels of various thicknesses into close contact with the wall.

Figure 3:
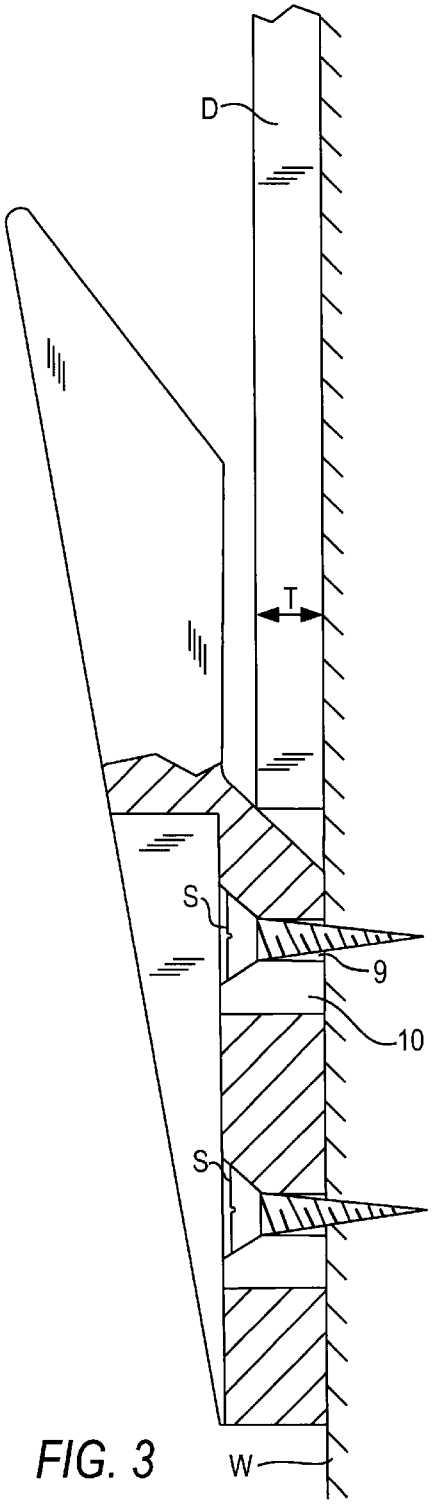
FIG. 3 is a partial cross section of the inventive installation tool with dashed lines showing cutaway section and screw slots. The figure shows a drywall work piece being positioned against an underlying wall by the tool, as well as the position of the screws during installation of dry wall material.
Figure 4:
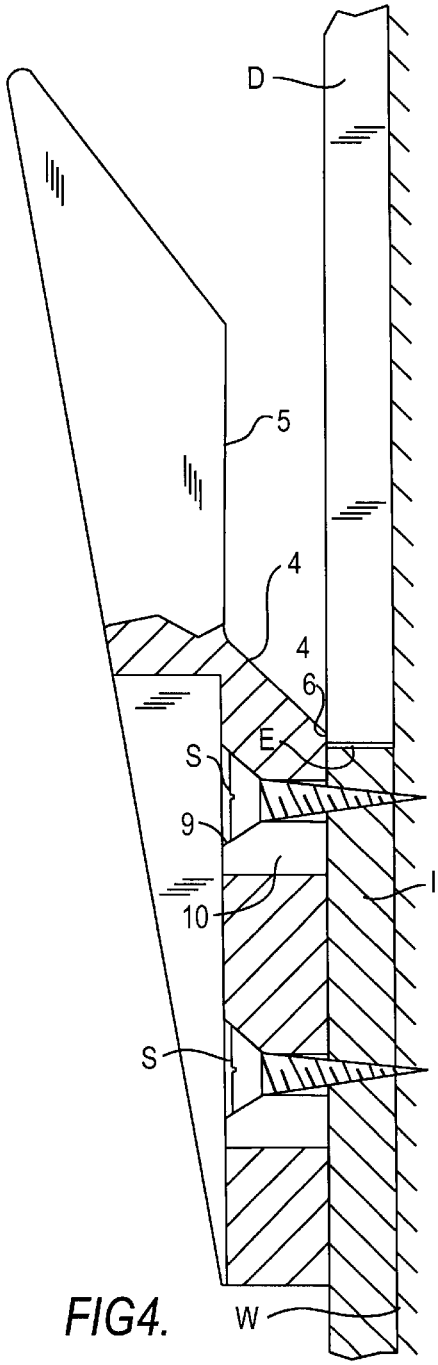
FIG. 4 shows a partial cross sectional view of the inventive installation tool with dashed lines showing cutaway section and screw slots. The figure shows a drywall work piece being positioned by the tool adjacent to an earlier installed drywall section.

As shown most clearly in FIGS. 2, 3 and 4, screw slots (9) are designed such that the tool may be removed from the wall after drywall is installed. Referring to FIG. 2, it is seen that the screw slots (9) further comprise irregularly cut screw holes (10) having narrow and wide ends. When in use, the heads of the screws are positioned over the narrow portions of the screw holes to prevent the tool from disengaging the wall. After installation is complete, the tool may be pulled upward manually such that the screw heads are positioned over the wide portions of the screw holes, allowing the tool to become disengaged from the wall. The screws may then be sunk to the surface of the drywall (or below).

The inventive tool may be employed in a variety of installation types. FIG. 3 depicts the installation of a drywall section onto an underlying wall as was described above with reference to FIG. 1. Note, however, that the drywall section depicted is significantly thicker in direction "T" than the section depicted in FIG. 1. FIG. 3 also shows the placement of screws (S) during the installation process.

FIG. 4. shows the installation of a drywall section (D) above and adjacent to a previously installed drywall section (I). Here, the tool is positioned on the previously installed drywall such that a portion of its mounting surface (6) extends beyond the upper edge (E) of the previously installed section. The section being installed is initially lowered into a gap defined by the wall surface, the upper edge (E), the second angled surface (4) and the inner surface (5). The second angled surface serves to force the drywall section against the wall and into a pocket defined by the wall, the upper edge (E) and the portion of the mounting surface (6) extending above the upper edge.

Figure 5:
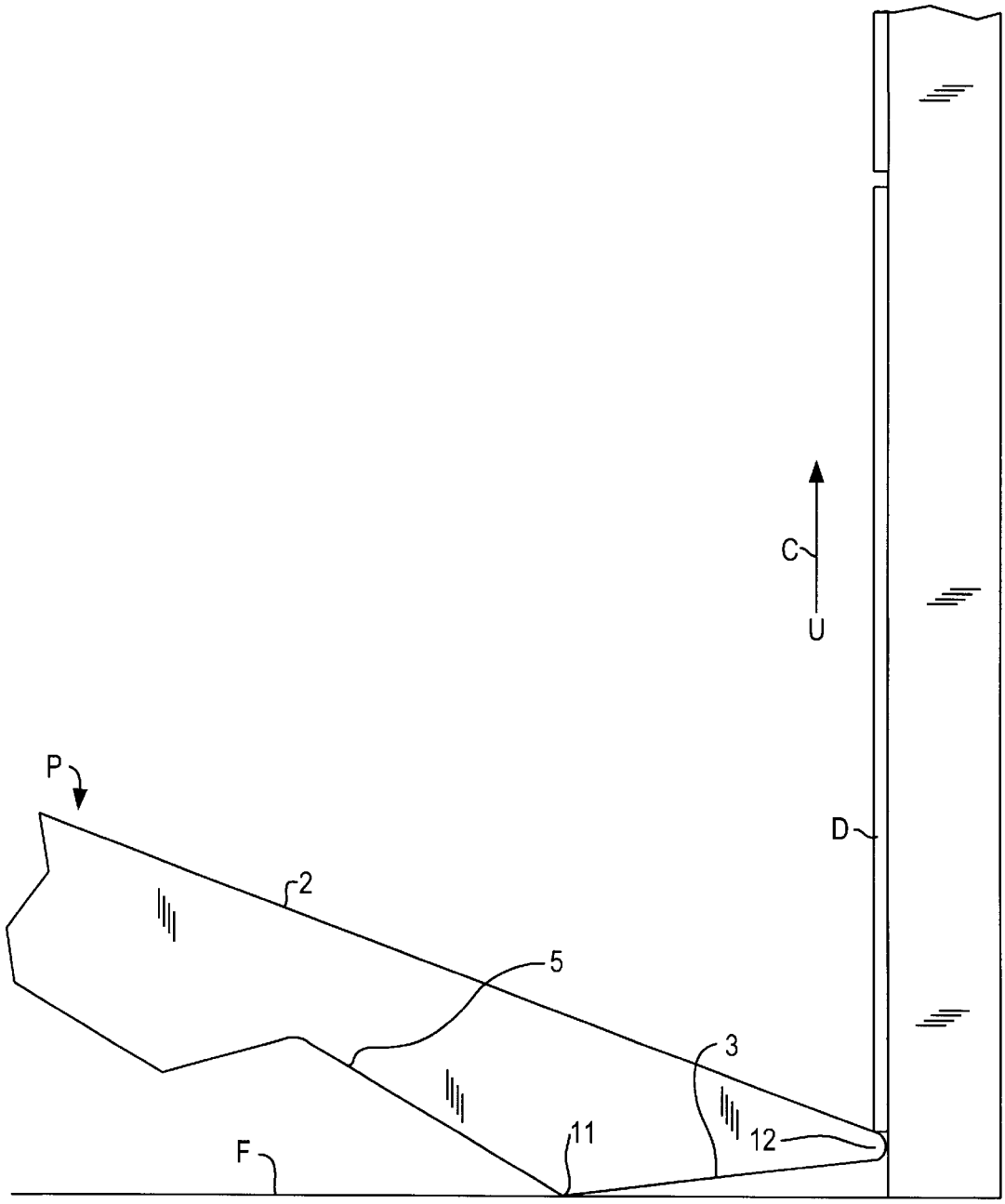
FIG. 5 is a side view of the tool being used to lift a drywall section.

The inventive tool also is to be used to lift drywall sections. In FIG. 5 the tool is placed on the floor (F) and permitted to pivot on a fulcrum (11) formed at the intersection of the first angled surface (3) and the inner surface (5). In practice, the tip of the tool (12), formed by the intersection of the first angled surface (3) and the outer surface (2), is placed below the section of drywall to be lifted With the fulcrum in contact with the floor. Downward pressure (P) is applied to the outer surface remote from the tool's tip, causing the tip (11) to rise and upwardly push the drywall section to a desired height, typically to a mounting height.

While the present invention has been particularly described with respect to the illustrated embodiment, it will be appreciated that various alterations, modifications and adaptations may be made on the present disclosure, and are intended to be within the scope of the present invention. It is intended that the appended claims be interpreted as including the embodiment discussed above, those various alternatives, which have been described, and all equivalents thereto.

What is claimed:

1. A tool for positioning and installing paneling sections, comprising:

an outer surface, a first angled surface, an inner surface adjacent said first angled surface, a second angled surface adjacent said inner surface, and a mounting surface adjacent said second angled surface, said mounting surface further comprising screw slots capable of engaging and disengaging with screws, wherein:

said mounting surface is capable of being secured to a wall via screws in said screw slots, when the tool is secured to a wall, said inner surface, second angled surface and said wall form a gap capable of holding a paneling section, said second angled surface being capable of forcing a paneling section placed in said gap into close contact with said wall, and said first angled surface is capable of guiding a paneling section into said gap.

2. The tool of claim 1, wherein a fulcrum is formed at an intersection between said first angled surface and said inner surface, and wherein a tip is formed at an intersection between said first angled surface and said outer surface.

3. A method of using a tool for lifting paneling sections, comprising the steps of:

placing the tool comprising an outer surface, a first angled surface, an inner surface adjacent said first angled surface, a second angled surface adjacent said inner surface, and a mounting surface adjacent said second surface, said mounting surface further comprising screw slots capable of engaging and disengaging with screws wherein: a fulcrum is formed at an intersection between said first angled surface and said inner surface, and wherein a tip is formed at an intersection between said first angled surface and said outer surface on a substantially horizontal surface such that said tip is positioned on a said substantially horizontal surface beneath a paneling section such that said fulcrum is adjacent said surface, and applying downward pressure to a portion of said outer surface remote from said paneling section, whereby said tip will move upward and push said paneling section upward.

4. A method of using a tool for positioning and installing paneling, comprising the steps of:

securing the tool comprising an outer surface, a first angled surface, an inner surface adjacent said first angled surface, a second angled surface adjacent said inner surface, and a mounting surface adjacent said second surface, said mounting surface further comprising screw slots capable of engaging and disengaging with screws to a wall to form a gap between the tool and the wall to receive a paneling section;

positioning a paneling section within said gap, and securing said paneling section to said wall.

5. The method of claim 4, further comprising the step of repositioning said paneling prior to securing it to said wall.

* * * * *